United States Patent [19]

Matsushita et al.

[11] 4,401,061

[45] Aug. 30, 1983

[54] REDUCTION OF DISTORTION OF PORTIONS OF THE CYLINDER WALL IN A TWO STROKE ENGINE

[75] Inventors: Yukio Matsushita, Iwata; Yoshihiro Gohara, Shizuoka, both of Japan

[73] Assignee: Yamaha Hatsudoki Kabushiki Kaisha, Iwata, Japan

[21] Appl. No.: 161,230

[22] Filed: Jun. 20, 1980

[30] Foreign Application Priority Data

Jun. 29, 1979 [JP] Japan ..... 54-82429

[51] Int. Cl.[3] ..... F02F 1/16

[52] U.S. Cl. ..... 123/41.84; 123/41.74; 123/41.79; 123/59 B

[58] Field of Search ..... 123/41.72, 41.74, 41.79, 123/41.83, 41.84, 193 C, 59 B

[56] References Cited

U.S. PATENT DOCUMENTS 3,261,337 7/1966 Müller ..... 123/41.74

FOREIGN PATENT DOCUMENTS 1805927 6/1970 Fed. Rep. of Germany ... 123/41.79
2012762 10/1971 Fed. Rep. of Germany ... 123/193 C
52-105615 8/1977 Japan .

*Primary Examiner*—Craig R. Feinberg
*Assistant Examiner*—W. R. Wolfe
*Attorney, Agent, or Firm*—Donald D. Mon

[57] ABSTRACT

A two stroke engine has a pair of adjacent cylinders. The exhaust passage from one cylinder passes near the other cylinder. Localized distortion of the other cylinder is reduced or prevented by placing isolation, insulation, or cooling means in the region between the exhaust passage and the other cylinder.

18 Claims, 9 Drawing Figures

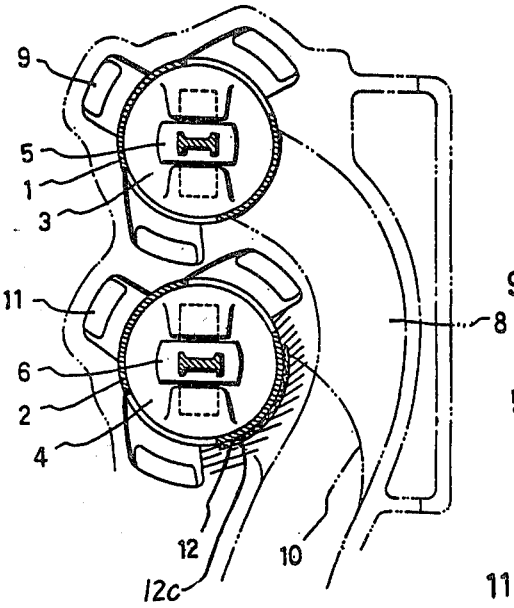
FIG. 6
FIG. 7
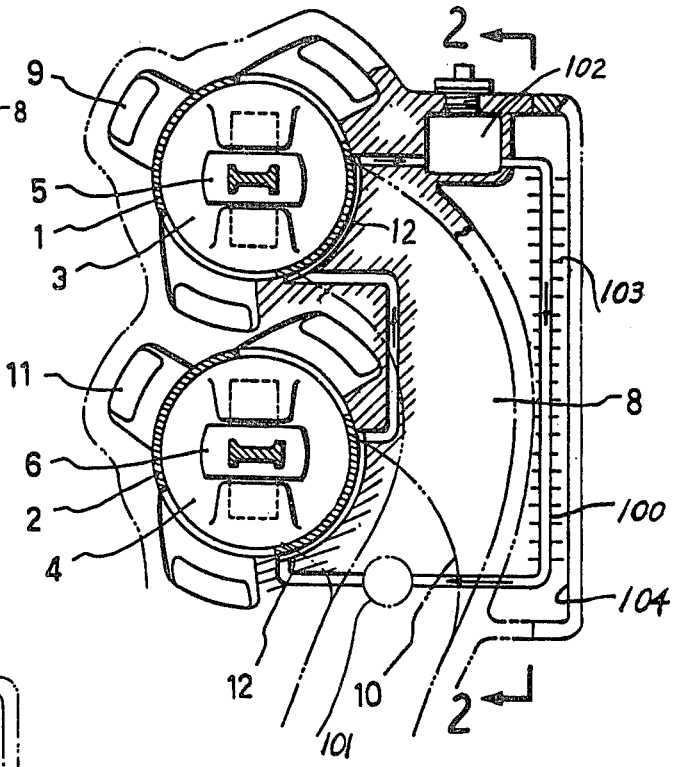
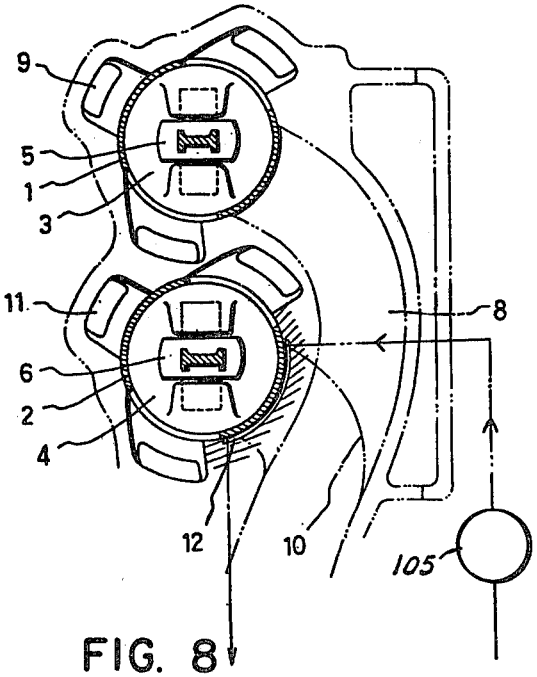
FIG. 8
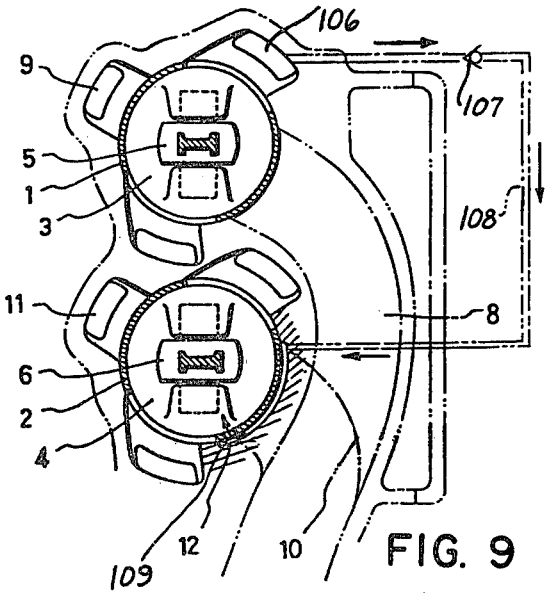
FIG. 9

REDUCTION OF DISTORTION OF PORTIONS OF THE CYLINDER WALL IN A TWO STROKE ENGINE

FIELD OF THE INVENTION

This invention relates to two stroke internal combustion engines, and in particular to the reduction or elimination of localized cylinder distortion by the heat from the exhaust passage.

BACKGROUND OF THE INVENTION

In multiple-cylinder two stroke internal combustion engines, especially in the type used for marine outboard engines, it is common for two cylinders to be side by side (juxtaposed). The exhaust passage from one cylinder passes near the other, and tends to overheat a localized portion of the other cylinder. The resulting out-of-roundness causes loss of power by blow-by, and accelerated wear. It is an object of this invention to overcome this problem.

BRIEF DESCRIPTION OF THE INVENTION

This invention is carried out in a multiple-cylinder two stroke engine where two cylinders are juxtaposed. The exhaust passage from one cylinder passes near the other. Isolation, insulation, or cooling means is placed between them to frustrate the heat flow, thereby to minimize or eliminate the distortion.

According to a preferred but optional feature of the invention, the isolation means comprises a spacing.

According to other preferred but optional features of the invention, the spacing can be filled with an insulating material or supplied with a flow of a cooling meduim.

The above and other features of this invention will be fully understood from the following detailed description and the accompanying drawings, in which:

BRIEF DESCRIPTION OF THE DRAWINGS

FIGS. 4–9 are views similar to FIG. 3, illustrating different embodiments of the invention.

DETAILED DESCRIPTION OF THE INVENTION

Figure 1:
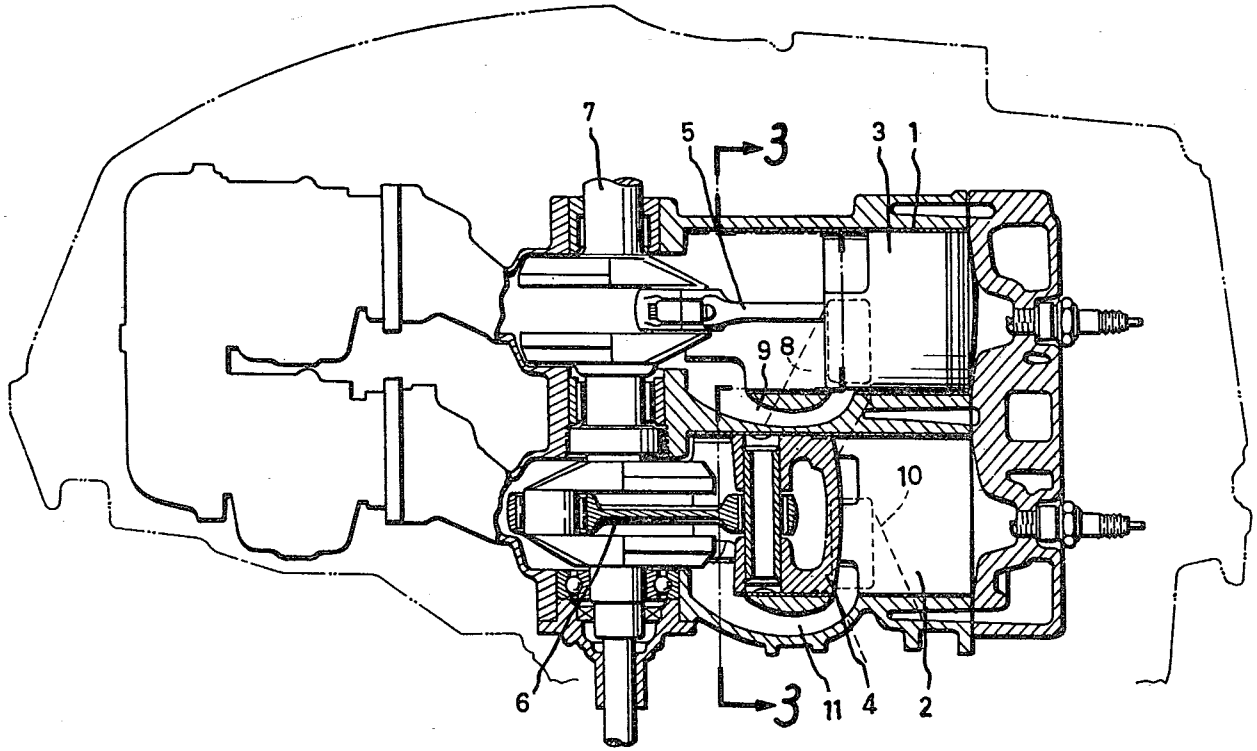
FIG. 1 is a sectional side elevation showing an essential portion of a two-cylinder two stroke engine.

FIG. 1 is a side elevation showing a two stroke engine which is to be used mainly for an outboard motor. The engine has cylinders 1 and 2 which are arranged one above the other and in the vicinity of each other. Into these cylinders 1 and 2, there are inserted respective pistons 3 and 4 which are so constructed as to drive a single vertical crankshaft 7 through respective connecting rods 5 and 6. The upper cylinder 1 is equipped with an exhaust passage 8 and a scavenging passage 9 on each side of the exhaust passage, and the lower cylinder 2 is also equipped with an exhaust passage 10 and a scavenging passage 11 on each side of the exhaust passage.

Figure 2:
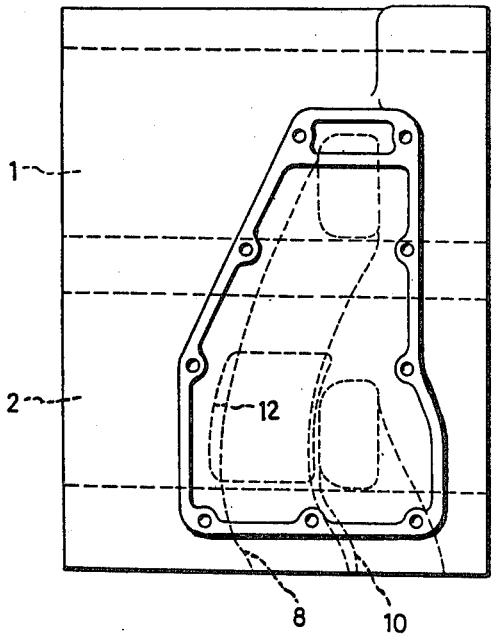
FIG. 2 is a front elevation of a cylinder block taken generally along line II—II of FIG. 3.
Figure 3:
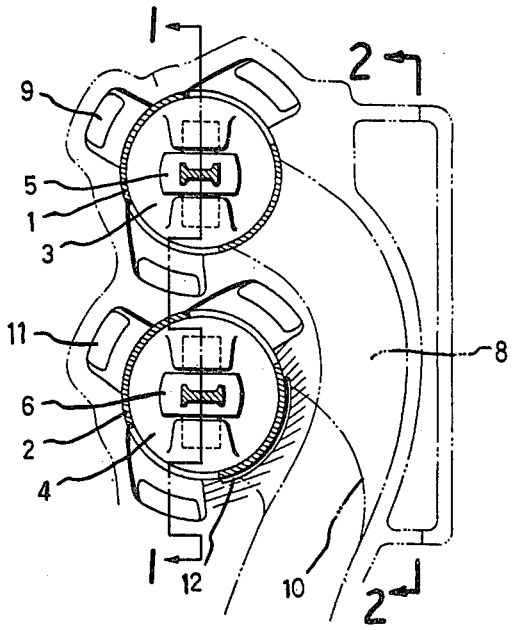
FIG. 3 is a section taken at line III—III in FIG. 1.

Now, in the two stroke engine having its cylinders 1 and 2 arranged one above the other, as has been described above, the exhaust passages 8 of the upper cylinder 1 is made to lead sidewardly of the lower cylinder 2, and opens into the water through a lower propeller casing (not shown). Thus, the upper cylinder 1 has its exhaust passage 8 arranged sidewardly of and in the vicinity of the lower cylinder 2 (as shown in FIGS. 2 and 3).

If hot exhaust gases are discharged from the exhaust port of the cylinder 1, the heat therein is conducted, when they pass near cylinder 2, to cylinder 2, thereby to cause a local overheating. As a result, the roundness of cylinder 2 may be deteriorated. This deterioration in the roundness of cylinder 2 has invited problems that an error is established in the clearance between the cylinder 2 and the piston 4 thereby to increase its blow-by, and that the piston and cylinder are unsymmetrically worn, thereby to shorten the lifetime of the engine.

The present invention has been conceived to eliminate the aforementioned drawbacks concomitant with the prior art and is characterized in that a space is formed in the side of the cylinder, which is located in the vicinity of the exhaust port, thereby to form an "insulating layer" so that the cylinder may be prevented from being deformed. The term "insulating layer" comprehends isolating by a mere separation, insulating by the placement of insulation material, and cooling by circulating coolant.

The present invention will now be described in connection with the embodiment thereof with reference to the accompanying drawings. As shown in FIGS. 2 and 3, an arcuate space 12 is formed sidewardly of lower cylinder 2 and is so arranged that exhaust passage 8 connected with upper cylinder 1 leads along the back thereof.

The position and size of the aforementioned space 12 are determined by the temperature distribution of the actual engine. In short, it is sufficient that the exhaust passage 8 is arranged not to establish any locally excessive temperature rise in cylinder 2 along which it leads.

As has been described in connection with the aforementioned embodiment, according to the present invention, the space 12 is formed sidewardly of the cylinder along and close to which the exhaust passage is extended and is used as the insulating layer. According to the present invention, therefore, since there takes place no local overheat in the lower cylinder due to the exhaust gases of the upper cylinder, the lower cylinder is prevented from being abnormally deformed so that its roundness can be maintained and that it can be prevented from being locally worn together with its piston, whereby the reduction in the efficiency due to the leak of the compressed gases and the shortening of the lifetime can be prevented.

Incidentally, although the aforementioned space 12 is frequently arranged in the vicinity of the outer circumference of the cylinder 2, as shown in FIG. 3, it may be formed in the wall which is slightly spaced from a sleeve of the cylinder 2. Moreover, the space 12 may desirably be so vented to the atmosphere that the heated air may be positively discharged thereby to prevent the cylinder from having its temperature locally raised. As the case may be, still moreover, the space may be filled up with an insulator thereby to further enhance its insulating effect.

Such alternative arrangements are shown in FIGS. 4–9, wherein like parts bear like numbers, which will not again be described.

Figure 4:
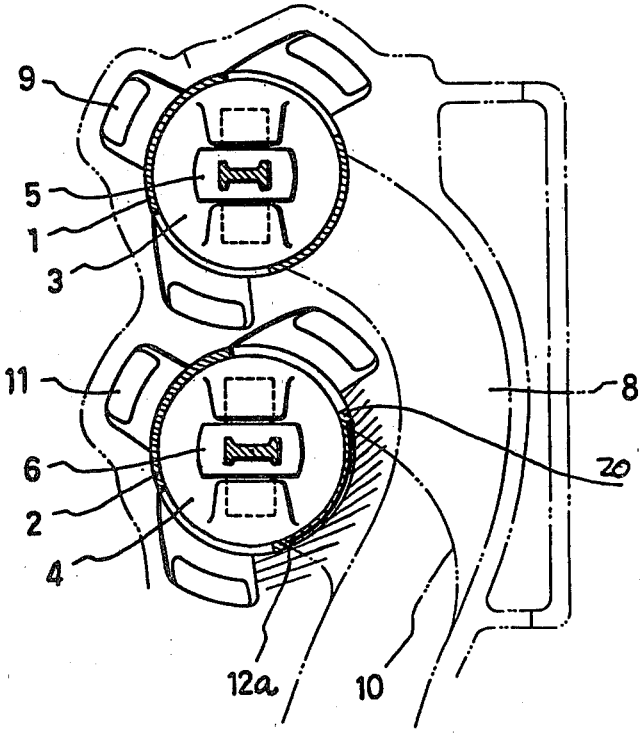

FIG. 4 shows that space 12, instead of being formed in the wall of the engine casting, can instead be formed as a generally rectangular recess **12*a* in the outside wall of the sleeve 20 (as in FIG. 1). As shown in FIGS. 1, 4** and 5 this spacing can be empty, and functions in an insulating manner by interrupting direct conduction of heat, and by whatever insulation is provided by the gases which fill it.

Figure 5:
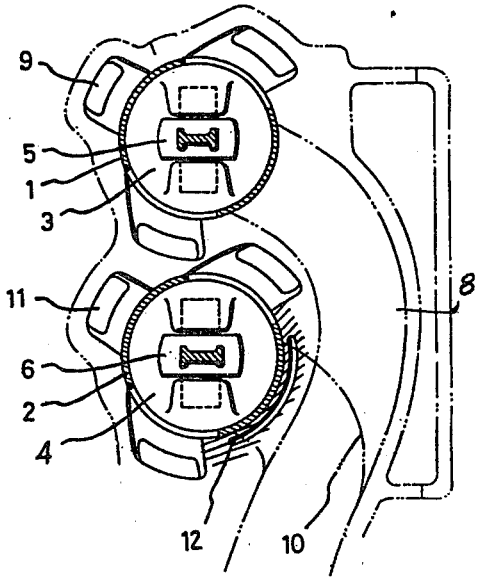

FIG. 5 illustrates that space 12 need not be contiguous to the sleeve. Instead spacing 12*b* is shown entirely contained in the engine casting, spaced from the sleeve. It has about the same shape and extent as space 12 in FIG. 1.

FIG. 6 illustrates that the spacing 12, 12*a*, or 12*b* can be filled with insulating material 12*c* of any suitable type which will lower the thermal conductivity across the spacing.

FIG. 7 shows the construction of FIG. 1 duplicated on both cylinders, with spacings 12 plumbed into a coolant flow circuit 100 that includes a pump 101, reservoir 102, and heat exchanger 103. Oil is circulated through the spacings, and its heat is transferred to water in water jacket 104.

FIG. 8 shows air or water being pumped to spacing 12 by pump 105. This coolant is simply discharged outside.

FIG. 9 shows a variation on FIG. 8, wherein mixture from scavenging port 106 passes through a check valve 107 and passage 108 to spacing 12, and from there through an aperture 109 in sleeve 2 into the crank chamber of the lower cylinder. This is a "self-pumping" system, and the mixture is the coolant.

This invention is not to be limited by the embodiments shown in the drawings and described in the description, which are given by way of example and not of limitation, but only in accordance with the scope of the appended claims.

We claim:

1. In a two stroke internal combustion engine wherein a pair of cylinders are juxtaposed to one another, and an exhaust passage passes from one of said cylinders along a path near the other of said cylinders, means to reduce localized heating of said other cylinder from said exhaust passage, comprising a spacing formed between said other cylinder and said exhaust passage, said spacing occupying a substantial frontal area between them and having no thermally conductive structure therein, whereby the entire area of said spacing functions as isolation means to isolate said cylinder from heat derived from exhaust gases in said exhaust passage, said other cylinder being provided as a sleeve in an engine block, said sleeve having an outer wall, said engine block having a bore with an internal wall surrounding, embracing and supporting said sleeve, said spacing being provided in the form of a relief in one of said walls.

2. Apparatus according to claim 1 in which said spacing is arcuate.

3. Apparatus according to claim 1 in which said spacing is formed in said outer wall of said sleeve.

4. Apparatus according to claim 1 in which said spacing is formed in said internal wall of said engine block.

5. Apparatus according to claim 1 in which said spacing contains insulation material.

6. Apparatus according to claim 1 in which said cylinders are provided with a respective scavenger port and a respective crank chamber, and in which conduitry connects to said scavenger port of one of said cylinders and discharges into the crank chamber of another of said cylinders, said spacing forming part of said conduitry.

7. Apparatus according to claim 1 in which said cylinders are provided with a respective scavenger port and a respective crank chamber, and in which conduitry connects to said scavenger port of one of said cylinders and discharges into the crank chamber of another of said cylinders, said spacing forming part of said conduitry.

8. Apparatus according to claim 1 in which said spacing is plumbed to conduitry for conducting coolant to and from said spacing.

9. Apparatus according to claim 8 in which said conduitry includes a pump to pump coolant to said spacing.

10. Apparatus according to claim 9 in which heat transfer means is provided to cool said coolant.

11. Apparatus according to claim 1 in which said spacing is plumbed to conduitry for conducting coolant to and from said spacing.

12. Apparatus according to claim 11 in which said conduitry includes a pump to pump coolant to said spacing.

13. Apparatus according to claim 12 in which heat transfer means is provided to cool said coolant.

14. Apparatus according to claim 11 in which each said cylinder includes a plurality of scavenger ports, and an exhaust port, said scavenger ports being disposed on opposite sides of said exhaust port, and said spacing extending for a substantial peripheral frontal extent between said scavenger ports.

15. Apparatus according to claim 14 in which said cylinders are provided with a respective scavenger port and a respective crank chamber, and in which conduitry connects to said scavenger port of one of said cylinders and discharges into the crank chamber of another of said cylinders, said spacing forming part of said conduitry.

16. Apparatus according to claim 14 in which said other cylinder is provided as a sleeve in an engine block, said sleeve having an outer wall, said engine block having a bore with an internal wall surrounding, embracing and supporting said sleeve, said spacing being provided in the form of a relief in one of said walls.

17. Apparatus according to claim 16 in which said spacing is formed in said outer wall of said sleeve.

18. Apparatus according to claim 16 in which said spacing is formed in said internal wall.

* * * * *